United States Patent [19]

Kitchen, III

[11] Patent Number: 4,609,379

[45] Date of Patent: Sep. 2, 1986

[54] FUEL ADDITIVE

[76] Inventor: George H. Kitchen, III, 646 Lakeview Cir., Rio Rancho, N. Mex. 87124

[21] Appl. No.: 621,073

[22] Filed: Jun. 15, 1984

[51] Int. Cl.[4] ..... C10L 1/22

[52] U.S. Cl. ..... 44/63; 44/57; 44/62; 44/72

[58] Field of Search ..... 44/57, 63, 62, 72

[56] References Cited

U.S. PATENT DOCUMENTS 2,534,309 12/1950 Sheffield ..... 44/57
3,334,046 8/1967 Dexter ..... 44/63
3,493,354 2/1970 Jones ..... 44/57
3,888,773 6/1975 Nnadi et al. ..... 44/63

*Primary Examiner*—Mrs. Y. Harris-Smith
*Attorney, Agent, or Firm*—Klaas & Law

[57] ABSTRACT

It has been discovered that a fuel additive comprising a major proportion of a high molecular weight amine, and minor proportions of naptha and a poly alpha olefin synthetic oil, together with a small amount of a biocide can be combined with distillate fuels such as kerosene and diesel fuels in a ratio of about one part additive to about 3,000 to about 10,000 parts of fuel to produce a polymerization and bacteria inhibitor, as well as a rust inhibitor which is capable of depolymerizing and dispersing sludge and sludge forming polymers in stored fuel.

2 Claims, No Drawings

FUEL ADDITIVE

BACKGROUND OF THE INVENTION

This invention relates to fuel additives and more particularly to diesel fuel additives which inhibit the polymerization of fuel components, the growth of bacteria in stored fuel, and corrosion inside the fuel tank.

With the increasing prevalence of standby power generation equipment for essential services, including hospitals, communication equipment and the like, it has become increasingly important to protect the fuel from degradation when stored for long periods of time. More recently, many of these standby motor generator systems have employed diesel engines making the stability of stored fuel an even more important consideration. Distillate fuels in general and diesel fuel in particular are prone with prolonged storage to form polymerizates which agglomerate into what is referred to as sludge which can clog fuel lines and fuel injectors preventing the reliable operation of the engine. In addition, water in the fuel and in the form of condensates in a partially filled storage tank will attack the metal of the tank forming rust which also promotes the polymerization of components in the fuel.

In addition, new regulations promulgated by the Environmental Protection Agency have recognized the problem of rusting tanks and require measures to prevent contamination of ground water which can occur from fuel leaking underground from rust perforated tanks.

Likewise, sludge formation can be accelerated by the growth of bacteria in the fuel.

Therefore, modern inhibitors should have the following characteristics in use.

The material should be a sludge dispersant. It is known that the deterioration of fuel oils involves polymerization reactions resulting in the agglomeration of macroscopic polymerizates into sludge. Although this reaction may be initiated by oxygen, additives containing antioxidants, such as hindered phenols or diamines of the types used in gasolines as gum inhibitors, are not totally effective for the purpose of preventing the polymerization mechanisms. The additive materials should also have rust-preventive properties. The additive materials should also be effective when the fuels are stored in the presence of metals and water and rust. The additive materials should also inhibit the propagation of bacteria.

The kinds of bacteria that grow in stored fuels thrive on nitrogen, sulfur, and phosphorus, as well as iron, generally in the form of its oxides. Bacterial growth can be reduced, if not eliminated, by employing the following preventive measures. A biocide should be employed. Of course, the elimination of materials in the fuel tank that contain nitrogen, sulfur or phosphorus would be helpful. Since the latter measure is practically impossible, these materials must be considered in the formulation of any additive. In addition, it is important to keep the fuel tanks clean and dry, in order to reduce or eliminate rust formation in the tanks.

Two standard test methods have been used as the best yardstick of an inhibitor's usefulness in prolonging fuel storage life. The first test is a variation of the color-stability test in Federal Specification VV-K-211 Kerosene. In addition to observing the color change, the amount of filterable sludge and sediment is also measured. The second test is a prolonged version of the Gulf Oil Company's Fuel Corrosion of Steel Test. The Bell Laboratories' version of these tests have been correlated against fuels actually stored in a stand-by power fuel tank. The first test is run at 210° F. until an observable amount of sludge has formed. This test is essentially an accelerated heat-stability test and is run in the absence of water. The second test is run at 120° F. over water in the presence of 1020 steel strip. This test is concluded after 12 weeks or when an observable quantity of rust and sludge has been deposited.

The accelerated heat-stability test is comparatively quick and useful for screening out the poorer additives; but because water is absent from this test, it is not capable of differentiating between those additives that are either ineffective rust inhibitors, or incapable of protecting the fuels when stored in contact with water and steel, and those that are effective under such storage conditions. It is precisely these conditions that are of importance since stand-by fuels are frequently in contact with metal and condensate water, and rusting may be often as severe a problem as sludge formation. A 12-week stability-and-rust test was designed to evaluate these effects.

Because of the importance of stabilizing the fuels for extended periods of up to 10 years with the fuels in contact with metal and water, it is also important that the additive exhibit properties which would enable it to be used as a reinhibitor and depolymerizer during its repeated use over prolonged periods of time.

The major oil companies and chemical manufacturers have provided a wide variety of inhibitors. Exemplary of the types of materials available are the following:

(1) nitrogen-containing, surface-active polymers such as duPont FOA-11 and duPont FOA-208.

(2) organic-soluble, surface-active, oxygenated amine such as Enjay Paradyne HO4. This product may also contain a minor amount of a polymeric dispersant.

(3) anionic fuel additives such as Apollo SDI-2R, a proprietary sludge inhibitor and dispersant as well as rust preventive, manufactured by Apollo Chemical Corporation.

(4) chelating-type metal deactivator such as an 80% solution of N,N'disalicylidene-1-2propanediamine in aromatic solvents.

(5) A film-forming metal deactivator such as Vanlube 601, R. T. Vanderbilt Company.

(6) an antioxidant such as 2,6 ditertiarybutyle-4-methylphenol provided in Enjay Parabar 441, and also, duPont A029.

To varying degrees, these materials alone or in various combinations have in the past provided some measure of protection for stored fuel with respect to some of the major properties required.

For very long term storage however, it is essential that the inhibitor employed be capable of being employed during routine maintenance to depolymerize and disperse the sludge that is inevitably formed.

It is also important that attempts to eliminate the problem of injector clogging at low temperature by the build up of hydrocarbon waxes in the fuel does not compound injector scoring problems by reducing or eliminating the lubricity of the fuel. It is therefore an objective of the present invention to provide a diesel fuel additive which inhibits the formation of sludge, and bacteria, in the fuel during long periods of storage. It is a further objective of the present invention to provide a fuel additive which inhibits the formation of rust in diesel fuel storage tanks.

It is yet another objective of the present invention to provide a fuel additive composition which is capable of depolymerizing and dispersing sludge and sludge forming polymers in diesel fuel and kerosene stored for long periods of time.

BRIEF SUMMARY OF THE INVENTION

It has been discovered that a fuel additive comprising a major proportion of a high molecular weight amine, and minor proportions of naptha and a poly alpha olefin synthetic oil, together with a small amount of a biocide can be combined with distillate fuels such as kerosene and diesel fuels in a ratio of about one part additive to about 3,000 to about 10,000 parts of fuel to produce a polymerization and bacteria inhibitor, as well as a rust inhibitor which is capable of depolymerizing and dispersing sludge and sludge forming polymers in stored fuel.

DETAILED DESCRIPTION OF THE INVENTION

As previously described, a wide variety of chemical compositions have been provided as fuel additives. Unfortunately, many of these compositions when used as recommended by their manufacturers do not provide all of the properties which overall are required in an effective inhibitor, or reinhibitor and depolymerizer for the long term storage of kerosene and diesel fuel.

The composition of the present invention utilizes a major proportion of a proprietary composition presently sold by the Ethyl Corporation under the trademark EDA3.

This clear amber liquid composition contains a high molecular weight amine, is basic and is believed to be a polymerization product of an analog or homology of ethylene diamine. The boiling point range of this composition begins at about 240° F. (116° C.). It is insoluble in water and has a density at 68° F. (20° C.). This composition is recommended by the manufacturer as the sole fuel additive to be used as an inhibitor of sludge formation. In addition to the foregoing, the EDA-3 contains additives which inhibit rust, such as certain chelating agents, and which help to demulsify and disperse sludge that is formed.

At 100% usage however, this composition does not properly diffuse in the fuel sufficiently to effectively provide any depolymerization function. When this composition is diluted with an aromatic solvent, such as naphtha in a manner contrary to the recommendation of composition, manufacturer in the proportions described hereinafter, the combination provides a more workable, effective depolymerizing agent which also helps to prevent wax build-ups which can be a problem in severe cold. Preferably, a naphtha, purchased from Union Chemicals Division of Union Oil Company of California, designated HA-40, is used. This composition contains single and double ring aromatics having a boiling range of from about 420° F. (216° C.) to about 545° F. (285° C.) and a specific gravity at 60° F. (16° C.) of about 0.98. This composition is also not soluble in water.

Due to the strong solvent action of the naphtha, it is desirable for the composition to contain a minor proportion of a poly alpha olefin, non-compounded synthetic oil such as Synfluid 6 cs sold by the Gulf Oil Company. This aliphatic hydrocarbon based synthetic oil, when used in the composition in about 25 parts per 100 parts of total composition, helps to provide the required lubricity for diesel injectors, pumps and the like.

Finally, most fuel additive compositions attempt to prevent polymerization due to bacteria growth and the subsequent sludge formation, by the use of up to 5% by weight of a biocide. Contrary to this prior practice, it has been found in the present composition that about 0.05 parts per 100 parts of the composition is an adequate level for the biocide selected. The preferred biocide used in the present invention is Hexalydro-1,3,5-Tris(2-Hydroxyethyl)S-Triazine ($C_9H_2$, $N_3O_3$). This component is sold by ONYX Chemical Company of Jersey City, N.J. under the trademark ONYXIDE 200.

To properly prepare the composition of the present invention, the ONYXIDE 200 is first added to one half of the HA-40. The poly alpha olefin is then added to the HA-40 and ONYXIDE 200. Next, the EDA-3 is added to the other half of the HA-40 and then the two HA-40 components are thoroughly mixed together.

The most preferred composition contains the following proportions:

50 parts by weight EDA-3
24.95 parts by weight HA-40
25 parts by weight of Poly alpha olefin
0.05 parts by weight ONYXIDE 200.

As previously discussed, the prior compositions for inhibiting the formation of sludge forming polymers, bacteria, and for the prevention of rust in fuel storage tanks were not particularly effective when subsequently applied to fuel storage tanks where polymerization and sludge had already formed to any substantial extent. Without being bound to any particular theory, it is postulated that macroscopic sludge, even if temporarily solubilized by other additive compositions, such as present in EDA-3, tends to reagglomerate relatively quickly thereby posing the same drawbacks to the fuel pick up, transfer and engine injector systems.

The composition of the present invention after successfully solubilizing or subdividing the macroscopic sludge also provides the capacity of dispersing the submacroscopic sludge agglomerates thereby retarding subsequent reagglomeration. This action in concert with the inhibition of polymerization provided by the components of the composition, in the quantities recited has been shown to be an effective fuel additive for stored fuel when used in a routine program of preventative maintenance.

The particular action described apparently minimizes the effect of bacteria, oxygen and even rust formation on the polymerization mechanisms that can occur in stored fuel.

Since none of the prior compositions completely eliminate the formation of agglomerated polymerizates in the form of gels and sludge it has been important to find a composition and method for reducing the deleterious effects from such activity. In comparison tests, such as those previously employed, the composition of the present invention has provided a hitherto unachieved benefit in this field.

The present invention has been described in its most preferred embodiments. The scope of this invention is not intended to be restricted by this disclosure but rather only by the applicable prior art as applied to the appended claims.

I claim:

1. A fuel additive for stored fuel capable of reducing the amount of macroscopic sludge particles formed from polymerization reactions promoted by bacteria and oxidation, where more than about 50 parts by weight of the additive comprises an amine selected from the group consisting of polymerization products of ethylene diamine, polymerization products of analogs and homologs of ethylene diamine, and mixtures thereof, about 25 parts by weight of an aromatic solvent selected from the group consisting of naphtha products having a boiling range of from about 420° F. (216° C.) to about 545° F. (285° C.), about 25 parts by weight of a poly alpha olefin synthetic oil and an effective amount of Hexahydro-1,3,5-Tris(2 Hydroxyethyl)S-Triazine biocide.

2. The fuel additive of claim 1 wherein the biocide is used in amounts of about 0.05 parts by weight of the fuel additive.

* * * * *